US012331445B2

(12) United States Patent
Chung

(10) Patent No.: US 12,331,445 B2
(45) Date of Patent: Jun. 17, 2025

(54) SYSTEMS AND METHODS FOR DETECTING OBJECTS ON TOP OF LAUNDRY TREATMENT APPLIANCES

(71) Applicant: Haier US Appliance Solutions, Inc., Wilmington, DE (US)

(72) Inventor: MyungGeon Chung, Seoul (KR)

(73) Assignee: Haier US Appliance Solutions, Inc., Wilmington, DE (US)

( * ) Notice: Subject to any disclaimer, the term of this patent is extended or adjusted under 35 U.S.C. 154(b) by 206 days.

(21) Appl. No.: 17/969,047

(22) Filed: Oct. 19, 2022

(65) Prior Publication Data

US 2024/0133098 A1 Apr. 25, 2024
US 2024/0229317 A9 Jul. 11, 2024

(51) Int. Cl.

*D06F 31/00* (2006.01)
*D06F 33/74* (2020.01)
*D06F 105/58* (2020.01)

(52) U.S. Cl.

CPC ..... *D06F 33/74* (2020.02); *D06F 2105/58* (2020.02)

(58) Field of Classification Search

CPC ..... D06F 29/00; D06F 29/005; D06F 31/00; D06F 34/14; D06F 35/00; D06F 95/00; D06F 2103/00; D06F 2105/58; D06F 2105/60

See application file for complete search history.

(56) References Cited

U.S. PATENT DOCUMENTS

| | | | | |
|---|---|---|---|---|
| 10,920,356 | B2 | 2/2021 | Hatfield et al. | |
| 11,098,430 | B2 | 8/2021 | Belveal et al. | |
| 2006/0229885 | A1 | 10/2006 | Kodama | |
| 2020/0240065 | A1* | 7/2020 | Underly | D06F 37/04 |
| 2021/0381152 | A1 | 12/2021 | Belveal et al. | |
| 2023/0340712 | A1* | 10/2023 | Chung | D06F 33/30 |

FOREIGN PATENT DOCUMENTS

| | | | |
|---|---|---|---|
| AU | 2019261703 | A1 | 5/2020 |
| CN | 101964098 | A | 2/2011 |
| CN | 108053574 | A | 5/2018 |
| CN | 105763652 | B | 5/2019 |
| CN | 110241553 | A | 9/2019 |
| CN | 109267289 | B | 2/2021 |
| JP | 2021107998 | A | 7/2021 |
| KR | 20060120933 | A | 11/2006 |
| KR | 20200032481 | A | 3/2020 |
| WO | WO2014198608 | A1 | 12/2014 |

* cited by examiner

*Primary Examiner* — David G Cormier
(74) *Attorney, Agent, or Firm* — Dority & Manning, P.A.

(57) ABSTRACT

A laundry operation system includes a laundry treatment appliance including a cabinet defining an exterior surface; a camera directed at the exterior surface to capture one or more images of the exterior surface of the laundry treatment appliance; and a controller operably coupled to the camera, the controller configured to perform an operation. The operation includes obtaining an image of the exterior surface of the laundry treatment appliance; detecting, based on the obtained image, a presence of an object on the exterior surface of the laundry treatment appliance; determining a user of the laundry treatment appliance after detecting the presence of the object; and notifying the user as to the presence of the object on the laundry treatment appliance.

9 Claims, 3 Drawing Sheets

SYSTEMS AND METHODS FOR DETECTING OBJECTS ON TOP OF LAUNDRY TREATMENT APPLIANCES

FIELD OF THE INVENTION

The present subject matter relates generally to laundry treatment appliances, and more particularly to detecting objects on top of commercial laundry treatment appliances.

BACKGROUND OF THE INVENTION

Laundry appliances generally include washing machine appliances and dryer appliances. Some laundry appliances are publicly available, such as commercial laundry appliances available for rent or temporary use. For example, such multiple laundry appliances may be installed in a laundromat, dormitory, or apartment building, etc. As a result, such laundry appliances will often be used by multiple people throughout a single day, most of whom do not know each other.

Although users typically try to remove all of their laundered clothing articles from a particular appliance (e.g., after such articles have been washed or dried), it is common for users to inadvertently leave one or more articles behind. In some cases, the user may not even realize an article has been left behind or is otherwise missing until he or she has left the laundromat, dormitory, or apartment building in which the laundry appliance is installed. Even if the article is discovered by a subsequent user, it may be difficult to for that subsequent user to determine who the prior user was or how to contact such a person. Although a list of users may be informally maintained (e.g., by a sign-in page), ensuring an accurate record is maintained may be difficult. Moreover, maintaining such a list may give rise to security or logistical concerns with coordinating communication between users that might not otherwise know each other.

As a result, it would be useful to provide an appliance or method that can help facilitate the discovery or return of clothing articles that are inadvertently left in a laundry appliance, or otherwise lost. In particular, it may be advantageous to facilitate the identification or notification of lost articles in a laundry with users who may have lost the articles in a safe and efficient manner.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a laundry operation system is provided. The laundry operation system may include a laundry treatment appliance including a cabinet defining an exterior surface; a camera directed at the exterior surface to capture one or more images of the exterior surface of the laundry treatment appliance; and a controller operably coupled to the camera, the controller configured to perform an operation. The operation may include obtaining an image of the exterior surface of the laundry treatment appliance; detecting, based on the obtained image, a presence of an object on the exterior surface of the laundry treatment appliance; determining a user of the laundry treatment appliance after detecting the presence of the object; and notifying the user as to the presence of the object on the laundry treatment appliance.

In another exemplary embodiment of the present disclosure, a method of operating a laundry system is provided. The laundry system may include a laundry treatment appliance and a camera configured to capture one or more images of the laundry treatment appliance. The method may include obtaining an image of the exterior surface of the laundry treatment appliance; detecting, based on the obtained image, a presence of an object on the exterior surface of the laundry treatment appliance; determining a user of the laundry treatment appliance after detecting the presence of the object; and notifying the user as to the presence of the object on the laundry treatment appliance.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
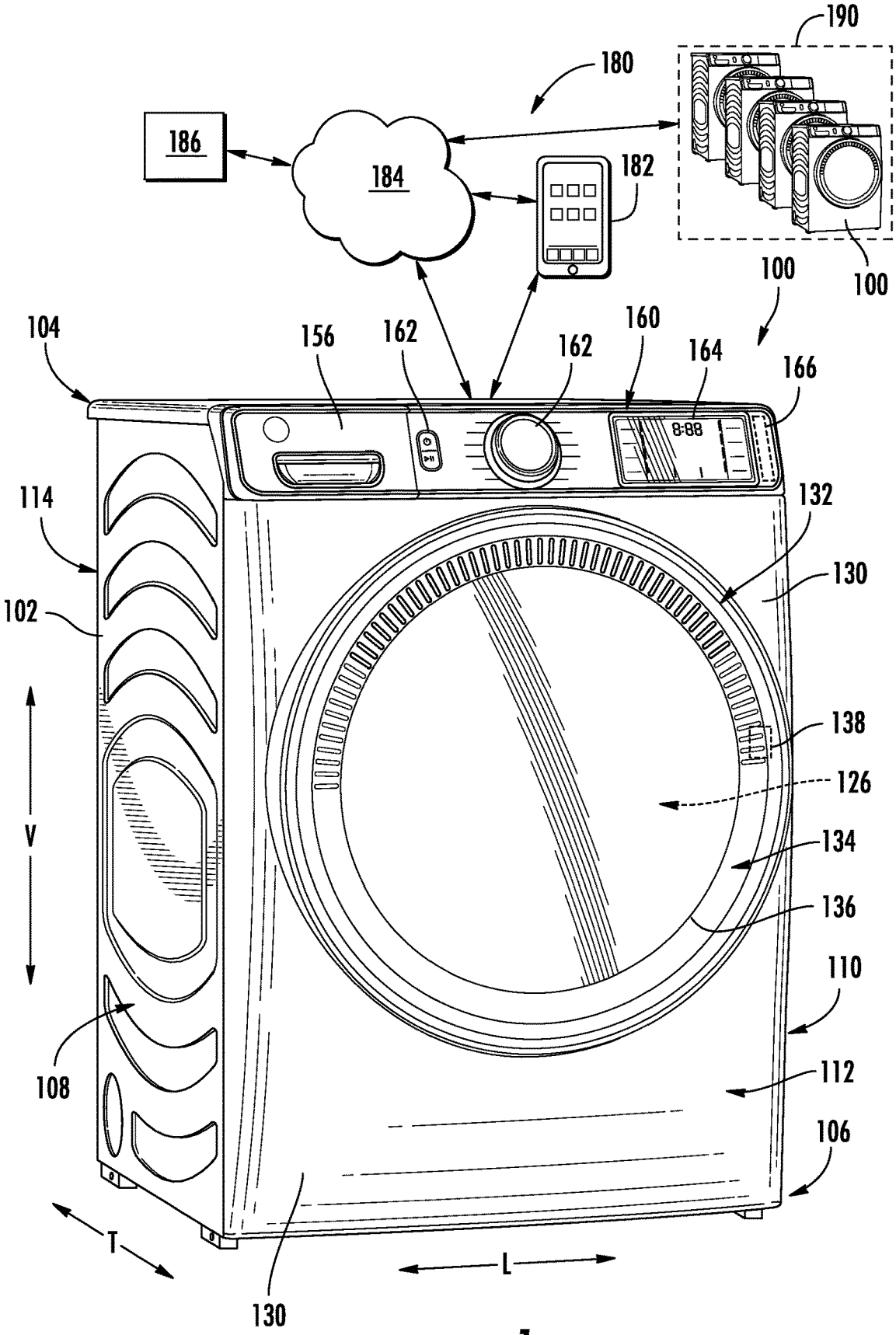
FIG. 1 provides a perspective view of an exemplary laundry treatment appliance according to an exemplary embodiment of the present subject matter.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Figure 2:
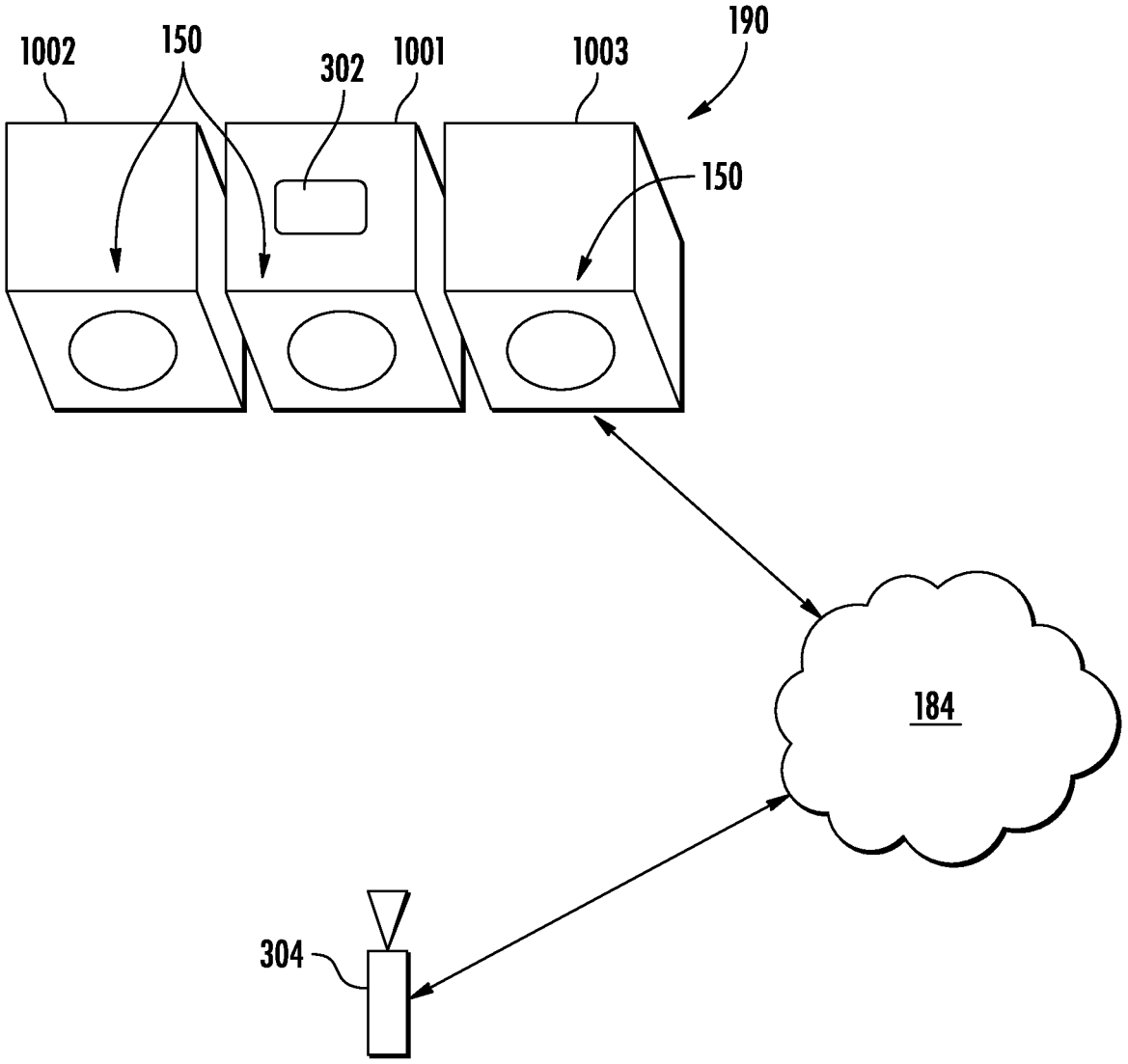
FIG. 2 provides a schematic diagram of a laundromat including a plurality of laundry treatment appliances according to exemplary embodiments of the present subject matter.
Figure 3:
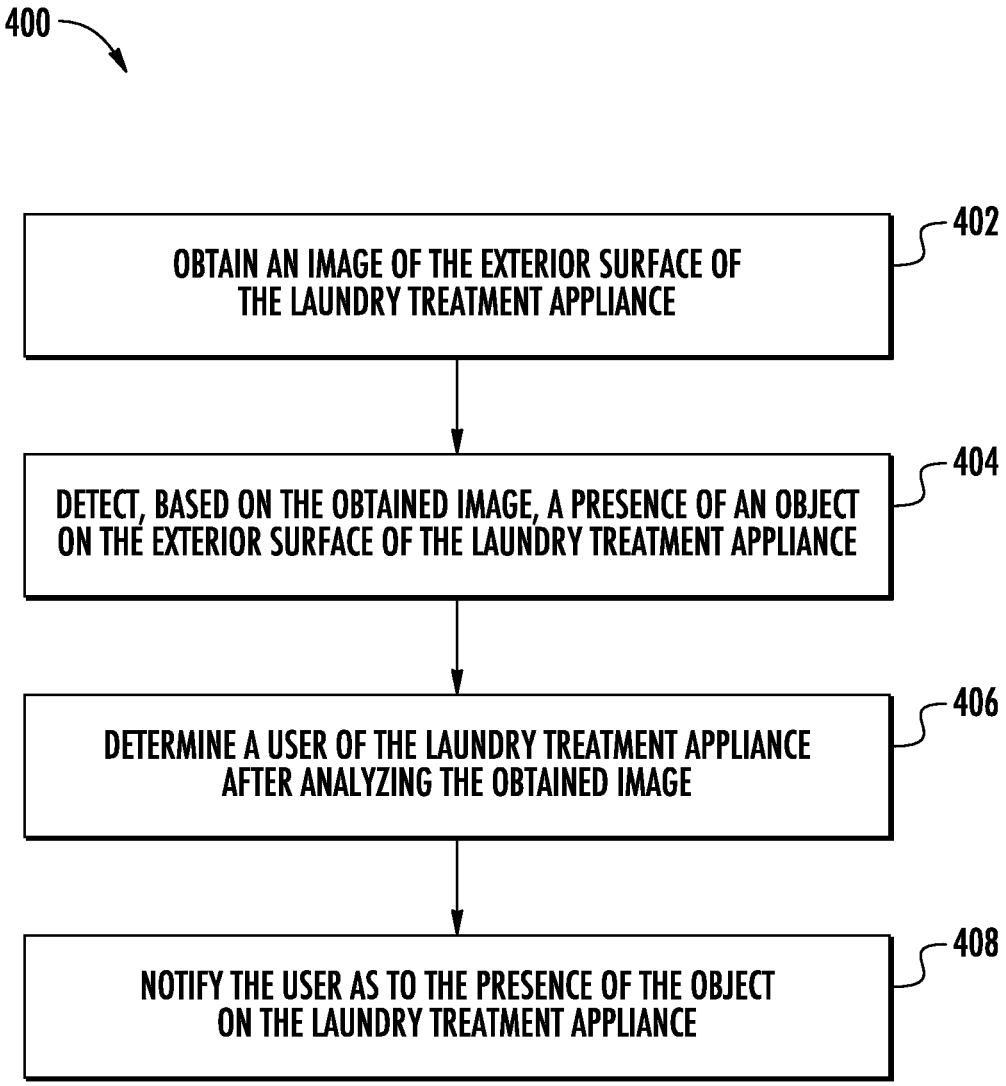
FIG. 3 illustrates a method for operating a laundry treatment appliance in accordance with one embodiment of the present disclosure.

Referring now to the figures, an exemplary laundry appliance that may be used to implement aspects of the present subject matter will be described. Specifically, FIG. 1 is a perspective view of an exemplary horizontal axis laundry treatment appliance (e.g., washing machine appliance) 100 and FIG. 2 is a schematic diagram of a plurality of laundry treatment appliances (e.g., within a laundromat). As illustrated, laundry treatment appliance 100 generally defines a vertical direction V, a lateral direction L, and a transverse direction T, each of which is mutually perpendicular, such that an orthogonal coordinate system is generally defined.

According to exemplary embodiments, laundry treatment appliance 100 includes a cabinet 102 that is generally configured for containing and/or supporting various components of laundry treatment appliance 100 and which may also define one or more internal chambers or compartments of laundry treatment appliance 100. In this regard, as used herein, the terms "cabinet," "housing," and the like are generally intended to refer to an outer frame or support structure for laundry treatment appliance 100, e.g., including any suitable number, type, and configuration of support structures formed from any suitable materials, such as a system of elongated support members, a plurality of interconnected panels, or some combination thereof. It should be appreciated that cabinet 102 does not necessarily require an enclosure and may simply include open structure supporting various elements of laundry treatment appliance 100. By contrast, cabinet 102 may enclose some or all portions of an interior of cabinet 102. It should be appreciated that cabinet 102 may have any suitable size, shape, and configuration while remaining within the scope of the present subject matter.

As illustrated, cabinet 102 generally extends between a top 104 and a bottom 106 along the vertical direction V, between a first side 108 (e.g., the left side when viewed from the front as in FIG. 1) and a second side 110 (e.g., the right side when viewed from the front as in FIG. 1) along the lateral direction L, and between a front 112 and a rear 114 along the transverse direction T. In general, terms such as "left," "right," "front," "rear," "top," or "bottom" are used with reference to the perspective of a user accessing laundry treatment appliance 100.

Cabinet 102 may include a front panel 130 which defines an opening 132 that permits user access to a wash basket (e.g., to insert laundry loads for washing). More specifically, laundry treatment appliance 100 includes a door 134 that is positioned over opening 132 and is rotatably mounted to front panel 130. In this manner, door 134 permits selective access to opening 132 by being movable between an open position (not shown) facilitating access to a wash tub and a closed position (FIG. 1) prohibiting access to the wash tub. Cabinet 102 may further include a top panel 150 (FIG. 2). Top panel 150 may define a top exterior surface of appliance 100, such that items 302 (e.g., clothing articles, personal keys, credit cards, detergents, etc.) (FIG. 2) may be placed upon top panel 150.

A window 136 in door 134 permits viewing of the wash basket when door 134 is in the closed position, e.g., during operation of laundry treatment appliance 100. Door 134 also includes a handle (not shown) that, e.g., a user may pull when opening and closing door 134. Further, although door 134 is illustrated as mounted to front panel 130, it should be appreciated that door 134 may be mounted to another side of cabinet 102 or any other suitable support according to alternative embodiments. Laundry treatment appliance 100 may further include a latch assembly 138 that is mounted to cabinet 102 and/or door 134 for selectively locking door 134 in the closed position and/or confirming that the door is in the closed position. Latch assembly 138 may be desirable, for example, to ensure only secured access to a wash chamber 126 or to otherwise ensure and verify that door 134 is closed during certain operating cycles or events.

A detergent drawer 156 may be slidably mounted within front panel 130. Detergent drawer 156 receives a wash additive (e.g., detergent, fabric softener, bleach, or any other suitable liquid or powder) and directs the fluid additive to the wash tub during operation of laundry treatment appliance 100. According to the illustrated embodiment, detergent drawer 156 may also be fluidly coupled to a water spout to facilitate the complete and accurate dispensing of wash additive. It should be appreciated that according to alternative embodiments, these wash additives could be dispensed automatically via a bulk dispensing unit (not shown). Other systems and methods for providing wash additives are possible and within the scope of the present subject matter.

Laundry treatment appliance 100 may include a control panel 160 that may represent a general-purpose Input/Output ("GPIO") device or functional block for laundry treatment appliance 100. In some embodiments, control panel 160 may include or be in operative communication with one or more user input devices 162, such as one or more of a variety of digital, analog, electrical, mechanical, or electro-mechanical input devices including rotary dials, control knobs, push buttons, toggle switches, selector switches, and touch pads.

Additionally, laundry treatment appliance 100 may include a display 164, such as a digital or analog display device generally configured to provide visual feedback regarding the operation of laundry treatment appliance 100. For example, display 164 may be provided on control panel 160 and may include one or more status lights, screens, or visible indicators. According to exemplary embodiments, user input devices 162 and display 164 may be integrated into a single device, e.g., including one or more of a touchscreen interface, a capacitive touch panel, a liquid crystal display (LCD), a plasma display panel (PDP), a cathode ray tube (CRT) display, or other informational or interactive displays.

Laundry treatment appliance 100 may further include or be in operative communication with a processing device or a controller 166 that may be generally configured to facilitate appliance operation. In this regard, control panel 160, user input devices 162, and display 164 may be in communication with controller 166 such that controller 166 may receive control inputs from user input devices 162, may display information using display 164, and may otherwise regulate operation of laundry treatment appliance 100. For example, signals generated by controller 166 may operate laundry treatment appliance 100, including any or all system components, subsystems, or interconnected devices, in response to the position of user input devices 162 and other control commands. Control panel 160 and other components of laundry treatment appliance 100 may be in communication with controller 166 via, for example, one or more signal lines or shared communication busses. In this manner, Input/Output ("I/O") signals may be routed between controller 166 and various operational components of laundry treatment appliance 100.

As used herein, the terms "processing device," "computing device," "controller," or the like may generally refer to any suitable processing device, such as a general or special purpose microprocessor, a microcontroller, an integrated circuit, an application specific integrated circuit (ASIC), a digital signal processor (DSP), a field-programmable gate array (FPGA), a logic device, one or more central processing units (CPUs), a graphics processing units (GPUs), processing units performing other specialized calculations, semiconductor devices, etc. In addition, these "controllers" are not necessarily restricted to a single element but may include any suitable number, type, and configuration of processing devices integrated in any suitable manner to facilitate appliance operation. Alternatively, controller 166 may be constructed without using a microprocessor, e.g., using a combination of discrete analog and/or digital logic circuitry (such as switches, amplifiers, integrators, comparators, flip-flops, AND/OR gates, and the like) to perform control functionality instead of relying upon software.

Controller 166 may include, or be associated with, one or more memory elements or non-transitory computer-readable storage mediums, such as RAM, ROM, EEPROM, EPROM, flash memory devices, magnetic disks, or other suitable memory devices (including combinations thereof). These memory devices may be a separate component from the processor or may be included onboard within the processor. In addition, these memory devices can store information and/or data accessible by the one or more processors, including instructions that can be executed by the one or more processors. It should be appreciated that the instructions can be software written in any suitable programming language or can be implemented in hardware. Additionally, or alternatively, the instructions can be executed logically and/or virtually using separate threads on one or more processors.

For example, controller 166 may be operable to execute programming instructions or micro-control code associated with an operating cycle of laundry treatment appliance 100. In this regard, the instructions may be software or any set of instructions that when executed by the processing device, cause the processing device to perform operations, such as running one or more software applications, displaying a user interface, receiving user input, processing user input, etc. Moreover, it should be noted that controller 166 as disclosed herein is capable of and may be operable to perform any methods, method steps, or portions of methods of appliance operation. For example, in some embodiments, these methods may be embodied in programming instructions stored in the memory and executed by controller 166.

The memory devices may also store data that can be retrieved, manipulated, created, or stored by the one or more processors or portions of controller 166. The data can include, for instance, data to facilitate performance of methods described herein. The data can be stored locally (e.g., on controller 166) in one or more databases and/or may be split up so that the data is stored in multiple locations. In addition, or alternatively, the one or more database(s) can be connected to controller 166 through any suitable network(s), such as through a high bandwidth local area network (LAN) or wide area network (WAN). In this regard, for example, controller 166 may further include a communication module or interface that may be used to communicate with one or more other component(s) of laundry treatment appliance 100, controller 166, an external appliance controller, or any other suitable device, e.g., via any suitable communication lines or network(s) and using any suitable communication protocol. The communication interface can include any suitable components for interfacing with one or more network(s), including for example, transmitters, receivers, ports, controllers, antennas, or other suitable components.

Referring again to FIG. 1, a schematic diagram of an external communication system 180 will be described according to an exemplary embodiment of the present subject matter. In general, external communication system 180 is configured for permitting interaction, data transfer, and other communications between laundry treatment appliance 100 and one or more external devices. For example, this communication may be used to provide and receive operating parameters, user instructions or notifications, performance characteristics, user preferences, or any other suitable information for improved performance of laundry treatment appliance 100. In addition, it should be appreciated that external communication system 180 may be used to transfer data or other information to improve performance of one or more external devices or appliances and/or improve user interaction with such devices.

For example, external communication system 180 permits controller 166 of laundry treatment appliance 100 to communicate with a separate device external to laundry treatment appliance 100, referred to generally herein as an external device 182. As described in more detail below, these communications may be facilitated using a wired or wireless connection, such as via a network 184. In general, external device 182 may be any suitable device separate from laundry treatment appliance 100 that is configured to provide and/or receive communications, information, data, or commands from a user. In this regard, external device 182 may be, for example, a personal phone, a smartphone, a tablet, a laptop or personal computer, a wearable device, a smart home system, or another mobile or remote device.

In addition, a remote server 186 may be in communication with laundry treatment appliance 100 and/or external device 182 through network 184. In this regard, for example, remote server 186 may be a cloud-based server 186, and is thus located at a distant location, such as in a separate state, country, etc. According to an exemplary embodiment, external device 182 may communicate with a remote server 186 over network 184, such as the Internet, to transmit/receive data or information, provide user inputs, receive user notifications or instructions, interact with or control laundry treatment appliance 100, etc. In addition, external device 182 and remote server 186 may communicate with laundry treatment appliance 100 to communicate similar information.

In general, communication between laundry treatment appliance 100, external device 182, remote server 186, and/or other user devices or appliances may be carried using any type of wired or wireless connection and using any suitable type of communication network, non-limiting examples of which are provided below. For example, external device 182 may be in direct or indirect communication with laundry treatment appliance 100 through any suitable wired or wireless communication connections or interfaces, such as network 184. For example, network 184 may include one or more of a local area network (LAN), a wide area network (WAN), a personal area network (PAN), the Internet, a cellular network, any other suitable short- or long-range wireless networks, etc. In addition, communications may be transmitted using any suitable communications devices or protocols, such as via Wi-Fi®, Bluetooth®, Zigbee®, wireless radio, laser, infrared, Ethernet type devices and interfaces, etc. In addition, such communication may use a variety of communication protocols (e.g., TCP/IP, HTTP, SMTP, FTP), encodings or formats (e.g., HTML, XML), and/or protection schemes (e.g., VPN, secure HTTP, SSL).

External communication system 180 is described herein according to an exemplary embodiment of the present subject matter. However, it should be appreciated that the exemplary functions and configurations of external communication system 180 provided herein are used only as examples to facilitate description of aspects of the present subject matter. System configurations may vary, other communication devices may be used to communicate directly or indirectly with one or more associated appliances, other communication protocols and steps may be implemented, etc. These variations and modifications are contemplated as within the scope of the present subject matter.

While described in the context of a specific embodiment of horizontal axis laundry treatment appliance 100, using the teachings disclosed herein it will be understood that horizontal axis laundry treatment appliance 100 is provided by way of example only. Other laundry treatment appliances having different configurations, different appearances, and/or different features may also be utilized with the present subject matter as well, e.g., vertical axis laundry treatment appliances.

Referring generally to FIGS. 1 and 2, laundry treatment appliance 100 may be utilized as a commercial washer in a laundromat or another commercial setting. In this regard, as used herein, discussion of the use of laundry appliances in a commercial setting may generally refer to the use of the appliance in any location where two or more appliances are provided for use by consumers. These commercial setting are commonly laundromats that include a large number of washers and dryers that are configured for pay-per-use operation, e.g., via cash, coins, digital currency, or other forms of payment.

For example, laundry treatment appliance 100 may be located in a laundromat (e.g., as identified generally by reference numeral 190) along with other laundry treatment appliances, dryer appliances, etc. (such as, e.g., a first laundry treatment appliance 1001, a second laundry treatment appliance 1002, a third laundry treatment appliance 1003, and the like). In general, each of the laundry appliances (e.g., washers and/or dryers) may all be in operative communication with each other and a remote server 186 through a network 184, as described above. In this manner, these network-connected appliances may communicate with each other to facilitate implementation of the various methods described herein. For example, each laundry treatment appliance within the laundromat 190 may communicate operating statuses or conditions to the remaining appliances, e.g., to facilitate determination of the actual operating capacity of the laundromat 190, as described in more detail below.

An exemplary laundromat may include one or more camera devices 304. For instance, camera devices 304 may include closed circuit television (CCTV) cameras, security surveillance cameras, optical sensors, infrared sensors motion sensing cameras, or the like. Optionally, multiple camera devices 304 may be placed spaced apart within the laundromat (e.g., to provide multiple views of the plurality of laundry treatment appliances 100 within the laundromat). Camera devices 304 may capture one or more images of exterior surfaces of each laundry treatment appliance 100 (e.g., top panel 150, front panel 130, etc.). For instance, the images may be still images, video images, burst images, or any combination of images. The captured images may then be retrieved or obtained by a controller (e.g., controller 166, or a separate, dedicated controller) via network 184. As will be explained below, the obtained images may be analyzed via one or more processors using a machine learning image recognition model.

Now that the construction of laundry treatment appliance 100 and the configuration of controller 166 according to exemplary embodiments have been presented, an exemplary method 400 of operating a laundry treatment appliance will be described. Although the discussion below refers to the exemplary method 400 of operating laundry treatment appliance 100, one skilled in the art will appreciate that the exemplary method 400 is applicable to the operation of a variety of other laundry treatment appliances or laundry appliances in general. In exemplary embodiments, the various method steps as disclosed herein may be performed by controller 166 or a separate, dedicated controller (e.g., on a remote server apart from a laundromat or one or more laundry treatment appliances).

At step 402, method 400 may include obtaining an image of an exterior surface of a laundry treatment appliance. In detail, a laundry treatment appliance (e.g., appliance 100) may be a commercial appliance provided in a laundromat as one of a plurality of appliances, as described above. A camera device (e.g., camera device 304) may capture one or more images of the appliance. For instance, the camera device may continuously record video of the plurality of appliances during operating hours of the laundromat. The video may be obtained (e.g., by a remote server such as remote server 184). According to some embodiments, the constant video feed is temporarily stored (e.g., for a predetermined storage time). One or more still images may be obtained or extracted from the video feed for further analysis (described below).

For instance, method 400 may include one or more triggers configured to initiate a recovery of a still image from the video feed. The one or more triggers may include detecting an item within the video feed (described below), detecting movement in the video feed, a timestamp, a date stamp, or the like. Thus, detection of a predetermined trigger may prompt the recovery of a still image from the video feed already in effect. According to some embodiments, the top panel of the appliance is defined (e.g., within the image or video feed). The trigger may include detecting a difference on or pertaining to the defined area of the top panel. In some such embodiments, 402 includes obtaining multiple (e.g., a pair of) sequential, two-dimensional images (e.g., at a set sample rate). Generally, each two-dimensional image includes multiple pixels (e.g., arranged in a predefined grid), as is understood. Sequential images (e.g., a previously-captured image and a more-recently-captured image) of the same field of view or line of sight may be compared at the controller (e.g., prior to being discarded). For instance, the sequential images may be compared to each other or to a baseline value/value set (e.g., of pixel brightness or color). Changes in the sequential images or changes from the baseline value/value set may be detected to indicate a presence of an object on the appliance. An elevated image value may be detected by any suitable comparison or pixel characteristic, such as brightness value or a color value that might indicate a change in a brightness value or a detection of movement (e.g., from corresponding pixels in the sequential two-dimensional images). Alternatively, the on-board image signal may be received and analyzed according to one or more image recognition process (e.g., as described below) such that object is identified as being located on the appliance based on image(s) captured on the machine camera.

At step 404, method 400 may include detecting, based on the obtained image, a presence of an object on the exterior surface of the laundry treatment appliance. In detail, upon obtaining the image, the method 400 may include determining that an object is located on the laundry treatment appliance. The laundry treatment appliance may be a first laundry treatment appliance among the plurality of laundry treatment appliances. Thus, the method 400 may include determining that the object is covering a predetermined area of an exterior top panel of the first appliance. According to some embodiments, the predetermined area is between about 25% and about 40%. For instance, an image recognition model (described below) may determine that at least 25% of a total surface area of the top panel is covered (e.g., by the object, a plurality of objects, etc.). Additionally or alternatively, the image recognition model may differentiate the first appliance from the rest of the plurality of appliances (e.g., by a position determination, a marker designation, etc.). It should be understood that the ranges described herein are by way of example only and that any suitable range for the predetermined area may be used.

The method 400 may include, as part of step 404, analyzing the obtained image to identify the object on the exterior surface (e.g., top panel) of the appliance. In detail the analysis of the first unique image may be performed by one or more computing devices using a machine learning image recognition model. It should be appreciated that any suitable image processing or recognition method may be used to analyze the image obtained at step 402 and facilitate evaluation of the one or more object characteristics. In addition, it should be appreciated that this image analysis or processing may be performed locally (e.g., by a controller on a corresponding external device) or remotely (e.g., by controller 156 or a remote server).

According to exemplary embodiments of the present subject matter, analyzing the obtained image (or images) may include analyzing the image(s) of the appliances using a neural network classification module and/or a machine learning image recognition process. In this regard, for example, the controller may be programmed to implement the machine learning image recognition process that includes a neural network trained with a plurality of images of laundry treatment appliances and potential objects located on the exterior surface of an appliance (e.g., including various colors, garments, sizes, shapes, etc.). By analyzing the image(s) captured using this machine learning image recognition process, the controller may properly evaluate the one or more object characteristics, e.g., by identifying the trained image that is closest to the obtained image.

As used herein, the terms image recognition process and similar terms may be used generally to refer to any suitable method of observation, analysis, image decomposition, feature extraction, image classification, etc. of one or more images or videos taken. In this regard, the image recognition process may use any suitable artificial intelligence (AI) technique, for example, any suitable machine learning technique, or for example, any suitable deep learning technique. It should be appreciated that any suitable image recognition software or process may be used to analyze obtained images and the controller may be programmed to perform such processes and take corrective action.

According to an exemplary embodiment, controller may implement a form of image recognition called region based convolutional neural network ("R-CNN") image recognition. Generally speaking, R-CNN may include taking an input image and extracting region proposals that include a potential object, such as a particular region containing laundry, garments, or the like. In this regard, a "region proposal" may be regions in an image that could belong to a particular object, such as a particular shape of a personal item, a laundry load, washing articles, or the like. A convolutional neural network may then be used to compute features from the regions proposals and the extracted features will then be used to determine a classification for each particular region.

According to still other embodiments, an image segmentation process may be used along with the R-CNN image recognition. In general, image segmentation creates a pixel-based mask for each object in an image and provides a more detailed or granular understanding of the various objects within a given image. In this regard, instead of processing an entire image—i.e., a large collection of pixels, many of which might not contain useful information—image segmentation may involve dividing an image into segments (e.g., into groups of pixels containing similar attributes) that may be analyzed independently or in parallel to obtain a more detailed representation of the object or objects in an image. This may be referred to herein as "Mask R-CNN" and the like.

According to still other embodiments, the image recognition process may use any other suitable neural network process. For example, step 404 may include using Mask R-CNN instead of a regular R-CNN architecture. In this regard, Mask R-CNN is based on Fast R-CNN which is slightly different than R-CNN. For example, R-CNN first applies CNN and then allocates it to zone recommendations on the covn5 property map instead of the initially split into zone recommendations. In addition, according to exemplary embodiments standard CNN may be used to analyze the image to determine various attributes or characteristics of the object. In addition, a K-means algorithm may be used. Other image recognition processes are possible and within the scope of the present subject matter.

It should be appreciated that any other suitable image recognition process may be used while remaining within the scope of the present subject matter. For example, step 404 may include using a deep belief network ("DBN") image recognition process. A DBN image recognition process may generally include stacking many individual unsupervised networks that use each network's hidden layer as the input for the next layer. According to still other embodiments, step 404 may include the implementation of a deep neural network ("DNN") image recognition process, which generally includes the use of a neural network (computing systems inspired by the biological neural networks) with multiple layers between input and output. Other suitable image recognition processes, neural network processes, artificial intelligence ("AI") analysis techniques, and combinations of the above described or other known methods may be used while remaining within the scope of the present subject matter.

The method 400 may include determining that the object is contacting the first laundry treatment appliance. As mentioned above, a plurality of appliances may be provided in close proximity to each other within a central location. During the analysis of the obtained image, the first laundry treatment appliance (or second or third or any suitable designation) may be differentiated from other appliances located close by. As mentioned briefly above, through the image recognition process, the model may differentiate the first laundry treatment appliance via a position designation, a location marker, an appliance marker, or the like. Accordingly, by comparing the recently captured image with a previously captured image, the model may accurately determine on which appliance the object is located. Thus, in analyzing the image, the method 400 may determine which specific appliance (e.g., the first laundry treatment appliance) the object is contacting.

The method 400 may include determining that the object is a laundry load. In detail, as a result of the analysis of the obtained image, it may be determined that the object is a laundry load placed on top of the appliance (e.g., the first laundry treatment appliance). For instance, in determining that a predetermined area of the top panel of the appliance is covered, the image recognition process may recognize one or more laundry garments and determine that a previously run laundry load has been placed on the top panel of the appliance. Additionally or alternatively, the image recognition process may compare the obtained image against a library of images including laundry garments to determine that the object is the laundry load.

At step 406, method 400 may include determining a user of the laundry treatment appliance after detecting the presence of the object on the appliance. As mentioned above, the image recognition process may determine which specific appliance (e.g., the first laundry treatment appliance) has or is contacting the present object. Accordingly, through a network connection, the image recognition process may determine the identity of one or more users of the specific laundry treatment appliance. For instance, in using the appliance, one or more users may establish an independent connection with the appliance (e.g., a wireless connection) through which they may make payments to use the machine. The independent connection may retrieve a user profile including contact information of the user during a laundry process. For instance, the model may retrieve previously recorded information (e.g., remote log-ins to appliances through mobile apps, remote payments submitted, user profile generated washing cycles, etc.) timestamped according to the previously performed laundry process. In some instances, a history of users of particular appliances is stored (e.g., on an on-board memory). The history of users may be limited to a predetermined number of users, a predetermined time period (e.g., 24 hours), or the like. Thus, the method 400 may include determining a list of users of the particular appliance during a predetermined time period.

A first user and a second user may be identified. In detail, the method 400 may include retrieving the history of users (e.g., of the first laundry treatment appliance) after detecting the object. For instance, a list of the last user—or last several users—to engage with or use the laundry appliance may be used for the selection. Such users may be tracked, for instance, based on their corresponding user profiles (e.g., used to unlock or pay for use of the laundry appliance). Optionally, the list may be ordered chronologically (e.g., in reverse chronological order). Additionally or alternatively, the list may be limited by a predetermined number of slots (e.g., one, two, or three), each slot being occupied by a separate prior-user profile. The list may prioritize more recent prior-user profiles. Thus, the list may be maintained as a rolling or regularly updated list that adds a new prior-user profile and removes an old prior-user profile with each new user or initiated cycle of the laundry appliance. The first prior-user profile may correspond to a first prior user that used (e.g., initiated a wash or dry cycle at) the laundry appliance. For instance, the first prior user may be the most recent user of the laundry appliance prior to the contemporary user.

For one example, the method 400 may detect an initiation of a laundry cycle after detecting the presence of the object on the first laundry treatment appliance. Accordingly, the object may be attributed or assigned to a first user (e.g., the first prior user or first user profile), the first user being a user immediately prior to the user initiating the current laundry cycle. Thus, the current laundry cycle may be attributed or assigned to a second user, such that the first and second users are catalogued in chronological order. In other words, the current user may be referred to as the second user and the previous user may be referred to as the first user. However, in alternative embodiments of method 400, any proper or suitable designation may be assigned to each user.

After detecting the initiation of the laundry cycle by the second user, the method 400 may include initiating a countdown timer (e.g., immediately after detecting the initiation of the laundry cycle). The countdown timer may be configured to monitor a time period for which the object is on the appliance. For instance, the countdown timer may run for a predetermined time period. The predetermined time period may vary according to the image analysis and identification of the object. Referring to the example given above when the object is determined to be a laundry load (e.g., belonging to the first user), the predetermined time period is between about 3 minutes and about 10 minutes. According to some embodiments, the predetermined time period is about 5 minutes.

At step 408, method 400 may include notifying the user as to the presence of the object on the laundry treatment appliance. In detail, the first user may be notified as to the presence of the object. The method 400 may include sending one or more notifications directly to the user. For instance, upon retrieving contact information of the first user (e.g., from the memory of the connected appliance), the method 400 may include, via the connected network, send a text message, a push notification, a mobile application (app) notification, a phone call, an email, or any other suitable form of contact to the first user. The first user may be notified after the expiration of the predetermined time period.

Accordingly, if the object (e.g., laundry load) is retrieved prior to the expiration of the predetermined time period, the first user is not notified. Advantageously, objects may be monitored and users notified to reduce the amount of lost objects in public areas.

According to another embodiment of the present disclosure, at step 404, method 400 may include determining that the object is not a laundry load. For instance, the image recognition process may determine that less than the predetermined surface area of the top panel (or any suitable external surface) of the appliance is covered. Additionally or alternatively, the image recognition process may determine that the object is a single object, such as a personal device. According to this example, the predetermined time period for the countdown timer is between about 10 minutes and about 20 minutes. Additionally or alternatively, the image recognition process may include storing a video clip of when the object is first identified.

Further to this example, the method 400 includes notifying an owner, manger, or operator of the building in which the appliance is located. For instance, a notification such as a text message, a push notification, an app notification, a phone call, an email, or any other suitable form of contact may be sent to the owner, manager, or operator. The notification may include the captured video clip showing the specific appliance (e.g., the first laundry treatment appliance), the object, and the user. In some instances, the notification is sent directly to the identified user (e.g., the first user), for instance in the even the identified object is not a mobile device.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A laundry operation system comprising:

a laundry treatment appliance comprising a cabinet defining an exterior surface;

a camera directed at the exterior surface to capture one or more images of the exterior surface of the laundry treatment appliance; and a controller operably coupled to the camera, the controller configured to perform an operation, the operation comprising:

obtaining an image of the exterior surface of the laundry treatment appliance;

detecting, based on the obtained image, a presence of an object on the exterior surface of the laundry treatment appliance;

determining a user of the laundry treatment appliance after detecting the presence of the object; and notifying the user as to the presence of the object on the laundry treatment appliance.

2. The laundry operation system of claim 1, wherein the laundry treatment appliance is a first laundry treatment appliance among a plurality of laundry treatment appliances.

3. The laundry operation system of claim 2, wherein detecting the presence of the object on the exterior surface of the laundry treatment appliance comprises:

determining that the object is contacting the first laundry treatment appliance.

4. The laundry operation system of claim 3, wherein determining the user of the laundry treatment appliance is a first user of the first laundry treatment appliance.

5. The laundry operation system of claim 4, wherein the operation further comprises:

detecting an initiation of a laundry cycle by a second user after detecting the presence of the object on the exterior surface of the laundry treatment appliance; and determining an expiration of a predetermined time period in response to detecting the initiation of the laundry cycle by the second user, wherein notifying the first user is in response to expiration of the predetermined time period.

6. The laundry operation system of claim 5, wherein the operation further comprises:

analyzing, by one or more computing devices using a machine learning image recognition model, the obtained image to identify the object;

determining that the object is a laundry load; and determining that a predetermined area of the exterior surface of the first laundry treatment appliance is covered by the laundry load.

7. The laundry operation system of claim 6, wherein the predetermined area is at least 30% of the exterior surface, the exterior surface being a top panel of the first laundry treatment appliance.

8. The laundry operation system of claim 6, wherein the predetermined time period is between 3 minutes and 5 minutes.

9. The laundry operation system of claim 5, wherein the operation further comprises:

analyzing, by one or more computing devices using a machine learning image recognition model, the obtained image to identify the object; and determining that the object is not a laundry load, wherein the predetermined time period is between 10 minutes and 20 minutes.

* * * * *